US007768794B1

(12) United States Patent
Wilson et al.

(10) Patent No.: US 7,768,794 B1
(45) Date of Patent: Aug. 3, 2010

(54) SURGE SUPPRESSION DEVICE WITH REPLACEABLE SURGE SUPPRESSION MODULES

(75) Inventors: James A. Wilson, Coeur d'Alene, ID (US); David A. Winton, Coeur d'Alene, ID (US); Daniel J. Sullivan, Spokane, WA (US)

(73) Assignee: Raycap, Inc., Post Falls, ID (US)

( * ) Notice: Subject to any disclaimer, the term of this patent is extended or adjusted under 35 U.S.C. 154(b) by 70 days.

(21) Appl. No.: 12/132,448

(22) Filed: Jun. 3, 2008

Related U.S. Application Data

(62) Division of application No. 10/885,812, filed on Jul. 6, 2004, now Pat. No. 7,397,673.

(51) Int. Cl.
*H01R 9/00* (2006.01)

(52) U.S. Cl. ..... 361/775; 361/652; 361/822

(58) Field of Classification Search ..... 361/652, 361/822–830
See application file for complete search history.

(56) References Cited

U.S. PATENT DOCUMENTS

| | | | | |
|---|---|---|---|---|
| 3,588,620 | A | | 6/1971 | Walleski |
| 4,346,311 | A | | 8/1982 | Aue et al. |
| 4,367,908 | A | | 1/1983 | Johnston |
| 4,389,695 | A | | 6/1983 | Carpenter, Jr. |
| 4,392,701 | A | | 7/1983 | Weidler |
| 4,775,328 | A | * | 10/1988 | McCarthy ..... 439/211 |
| 4,918,565 | A | | 4/1990 | King |
| 5,124,873 | A | | 6/1992 | Wheeler et al. |
| 5,907,475 | A | | 5/1999 | Babinski et al. |
| 5,984,731 | A | | 11/1999 | Laity |
| 5,989,062 | A | * | 11/1999 | Daoud ..... 439/532 |
| 6,113,432 | A | | 9/2000 | Liao |
| 6,220,880 | B1 | | 4/2001 | Lee et al. |
| 6,342,998 | B1 | | 1/2002 | Bencivenga et al. |
| 6,383,028 | B1 | | 5/2002 | Chang |
| 6,400,559 | B1 | | 6/2002 | Kohler et al. |
| 6,477,025 | B1 | | 11/2002 | Goldbach et al. |
| 6,621,974 | B1 | | 9/2003 | Chu |
| 6,671,357 | B1 | | 12/2003 | Roberts, Jr. |
| 7,397,673 | B1 | | 7/2008 | Wilson et al. |
| 2002/0141127 | A1 | | 10/2002 | Daugherty |
| 2005/0041447 | A1 | | 2/2005 | Khosla |
| 2005/0122689 | A1 | | 6/2005 | Pozzuoli |
| 2008/0038962 | A1 | | 2/2008 | Neumetzler et al. |

FOREIGN PATENT DOCUMENTS

DE 102004043763 B3 2/2008

OTHER PUBLICATIONS

Transtector "Keeping your power in line" http://www.transtector.com/productdetail?item=1000-994, and Product Photos 2008, (11 pages).

Transtector "Product Specification ALPU-BSU, Transtector PN: 1101-682" http://www.transtector.com/productdetail?item=1000-994, Mar. 19, 2003, (3 pages).

* cited by examiner

*Primary Examiner*—Tuan T Dinh
(74) *Attorney, Agent, or Firm*—Marger Johnson & McCollom, P.C.

(57) ABSTRACT

A surge suppression device includes a bus bar that extends along a length of the surge suppression device. Multiple surge suppression modules each have an attachment device that attaches and detaches to the bus bar without disrupting connections of other surge suppression modules coupled to the same bus bar.

25 Claims, 6 Drawing Sheets

SURGE SUPPRESSION DEVICE WITH REPLACEABLE SURGE SUPPRESSION MODULES

RELATED APPLICATION DATA

This application is a division of U.S. application Ser. No. 10/885,812, filed Jul. 6, 2004, now U.S. Pat. No. 7,397,673 herein incorporated by reference.

BACKGROUND

Surge suppressors are used to protect electronic equipment connected to a power line or data cable from voltage surges. Surge suppressors operate by providing an alternate electrical pathway having lower resistance for voltages exceeding a certain desired threshold. Providing an easier pathway for excess voltages prevents these voltage "surges" or "spikes" from traveling into and damaging electronic equipment connected to the AC circuit or data cable. Typical surge suppressors use Metal Oxide Varistors (MOVs) or Silicon Avalanche Diodes (SAD) to provide this alternate pathway.

In a surge suppression assembly, the MOV or SAD surge suppression circuits are connected to a bus bar. The bus bar provides an electrical coupling between a surge suppression circuit and an external contact such as a power line, a neutral line, or a ground. The bus bars must generally be placed on separate planes in order to secure an electrical coupling between them.

Conventional surge suppressors are generally not expandable to accommodate additional suppression needs. If, for example, a consumer using a conventional surge suppressor develops an increased need for surge suppression, in order to obtain a surge suppressor with a larger suppression capacity, they typically have to buy a completely new surge suppression assembly. Consumers are unable to simply upgrade their current surge suppressors to increase capacity.

Conventional surge suppressors are also bulky and inefficient in their use of box space. Also, existing surge suppression assemblies are not capable of swapping out damaged or destroyed surge suppression modules without disrupting the operation of other surge suppression modules that may currently be operating in the same enclosure.

The present invention addresses this and other problems associated with the prior art.

SUMMARY OF THE INVENTION

A surge suppression device includes a bus bar that extends along a length of the surge suppression device. Multiple surge suppression modules each have an attachment device that attaches and detaches to the bus bar without disrupting connections of other surge suppression modules coupled to the same bus bar.

The foregoing and other objects, features and advantages of the invention will become more readily apparent from the following detailed description of a preferred embodiment of the invention which proceeds with reference to the accompanying drawings.

DETAILED DESCRIPTION

Figure 1:
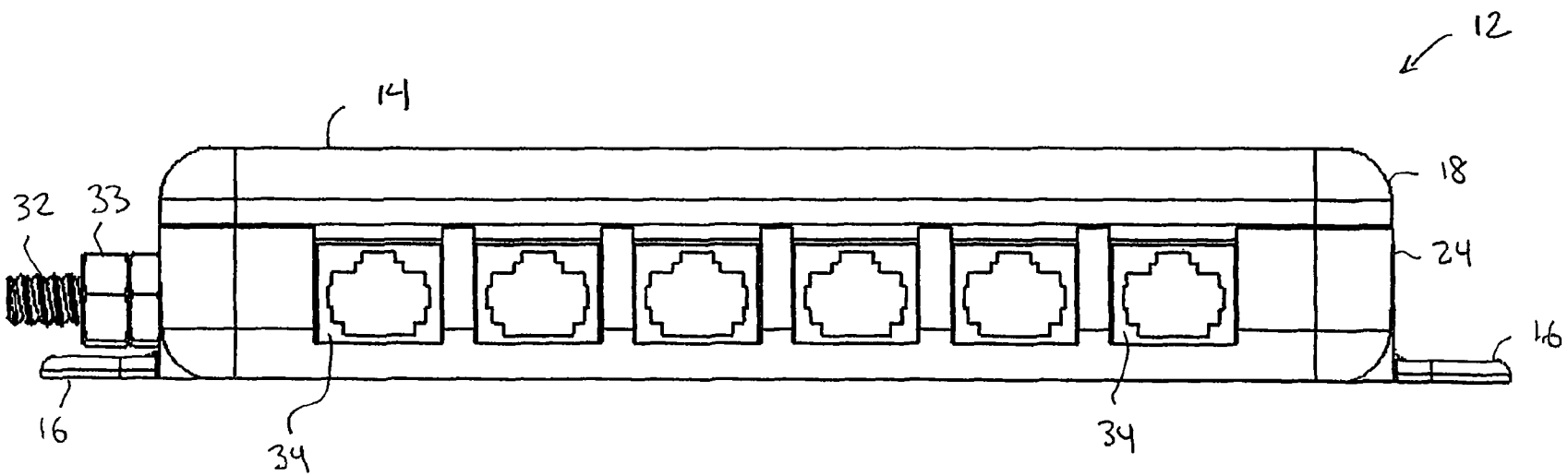
FIG. 1 is a front view of a surge suppression device.
Figure 2:
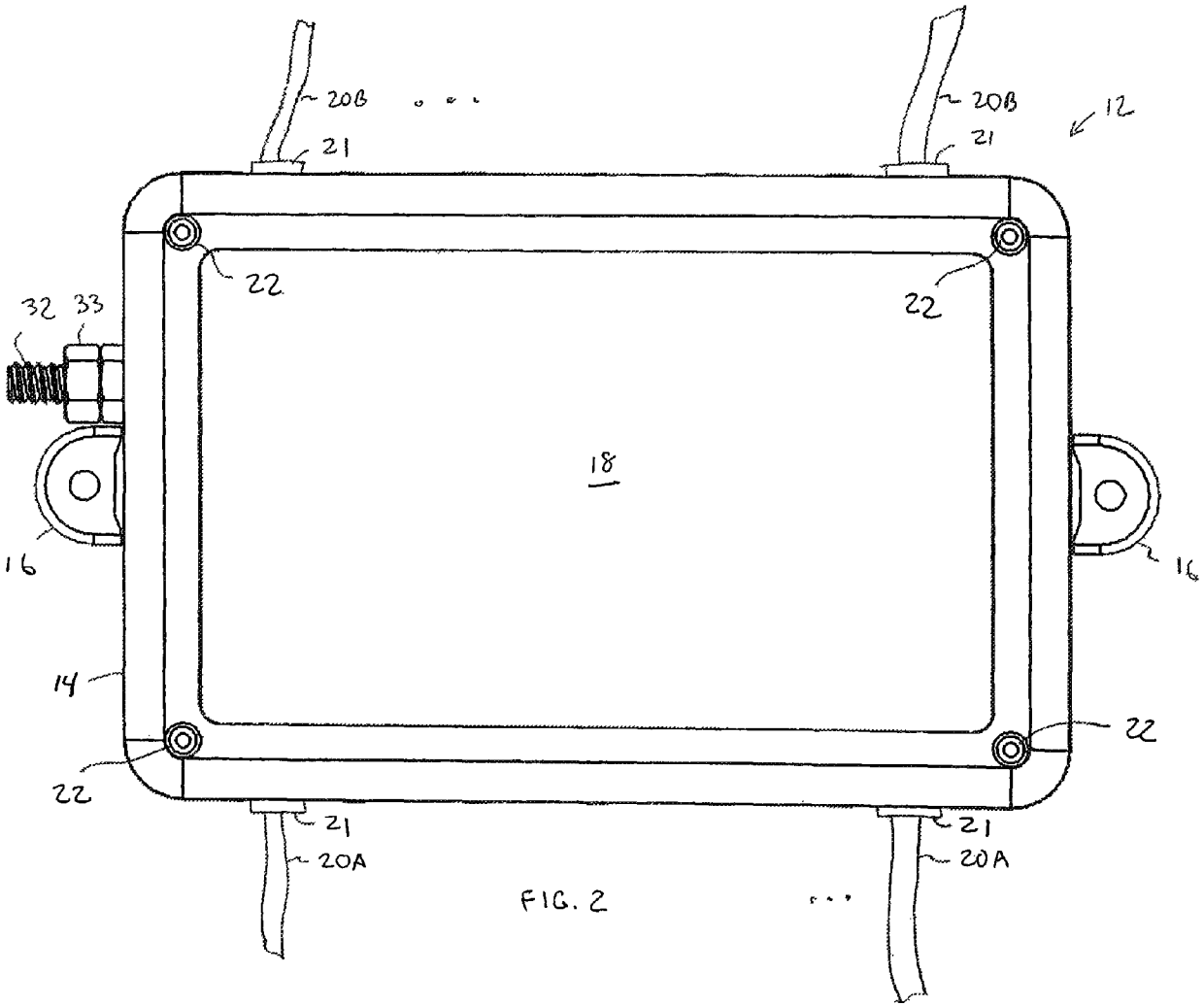
FIG. 2 is a top view of the surge suppression device shown in FIG. 1.

FIGS. 1 and 2 show a front and top view, respectively, of a surge suppression device 12. A back view of the surge suppression device 12 is substantially the same as the front view shown in FIG. 1. The surge suppression device 12 includes an enclosure 14 that in one embodiment is made of plastic. However, the enclosure 14 can be made out of any material including metal. Two tongues 16 on opposite sides of the enclosure 14 include holes for attaching the surge suppression device 12 to a wall.

A top lid 18 of the enclosure 14 is removable for inserting and removing individual surge suppression modules 30 shown in more detail below in subsequent figures. The lid 18 is attached to a bottom section 24 by screws 22. The enclosure 14 is approximately 15 centimeters long, 10 centimeters wide and 3 centimeters high.

The surge suppression device 12 is attached to different data cables 20 to prevent electrical power surges from damaging electrical equipment. In one specific application, the surge suppression module 12 is used to dissipate electrical power surges on telecommunication cables, such as the cables 20A and 20B shown in FIG. 2. For example, the cables 20A and 20B may be a T1 or E1 voice/data communication cables. In an alternative embodiment, the cables 20A and 20B can be for Plain Old Telephone Service (POTS) analog telephone lines. However, the surge suppression module 12 is easily adapted to accept any other type of cabling for any other type electrical equipment. In another embodiment, the connectors 34 can be replaced with hardwired terminals that have a screw that clamps directly onto the wires in the cable.

A first part of each cable 20A is connected to the front end of the surge suppression device 12 and a second part of each cable 20B is connected to a back end of the surge suppression device 12. Multiple individual surge suppression modules 30 inside the surge suppression device 12 direct power surges detected on either end 20A and 20B of the different cables to ground. This prevents the power surge from reaching and destroying electrical equipment connected to the cables 20A and 20B.

Multiple female connectors 34 (FIG. 1) are aligned on both the front and back end of the enclosure 14 and mate with corresponding male connectors 21 attached to the cables 20A and 20B. A bus bar 32 extends out from one side of the enclosure 14 and includes a nut 33 for clamping onto a ground wire (not shown).

Figure 3:
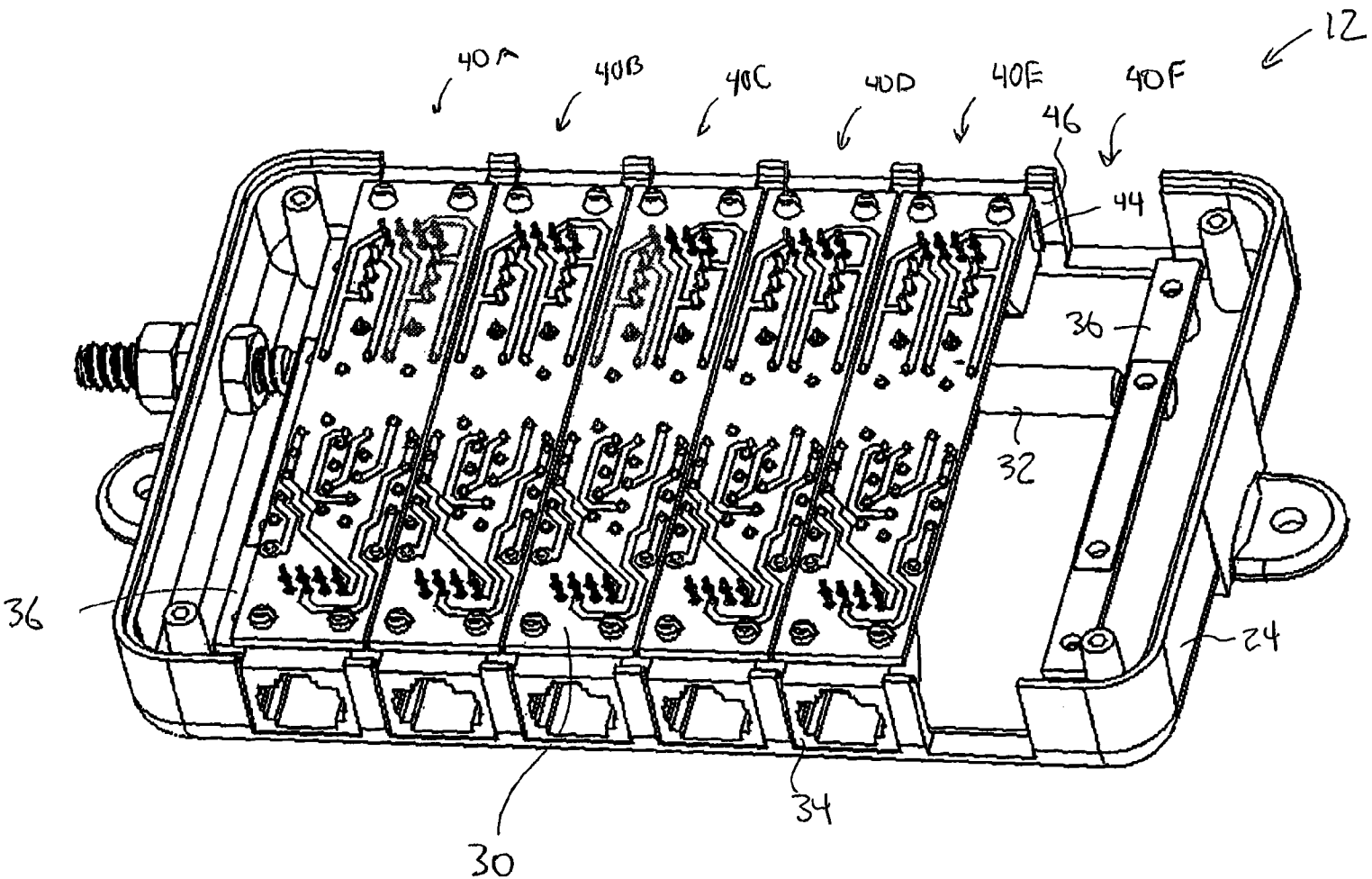
FIG. 3 is a perspective view of the surge suppression device with a top lid removed.

FIG. 3 shows the surge suppression device 12 with the top lid 18 removed. The specific embodiment of the surge suppression device 12 shown in FIG. 3 is sized to contain six slots 40A-40F each capable of receiving an associated surge suppression module 30. However, the surge suppression device 12 can be sized to contain more or less slots or sized to contain surge suppression modules 30 having different lengths and widths.

Slots 40A-40E are shown populated with surge suppression modules 30 and one of the slots 40F is shown empty with no inserted surge suppression module 30. The multiple surge suppression modules 30 insert side-by-side in a co-planar row and extend longitudinally inside the enclosure 14. Any number of the slots 40 can be populated with suppression modules 30. This allows a customer to purchase only the number of surge suppression modules 30 currently required for their particular operation and, if required, expand to add additional cable connections and modules 30 in the future.

Figure 4:
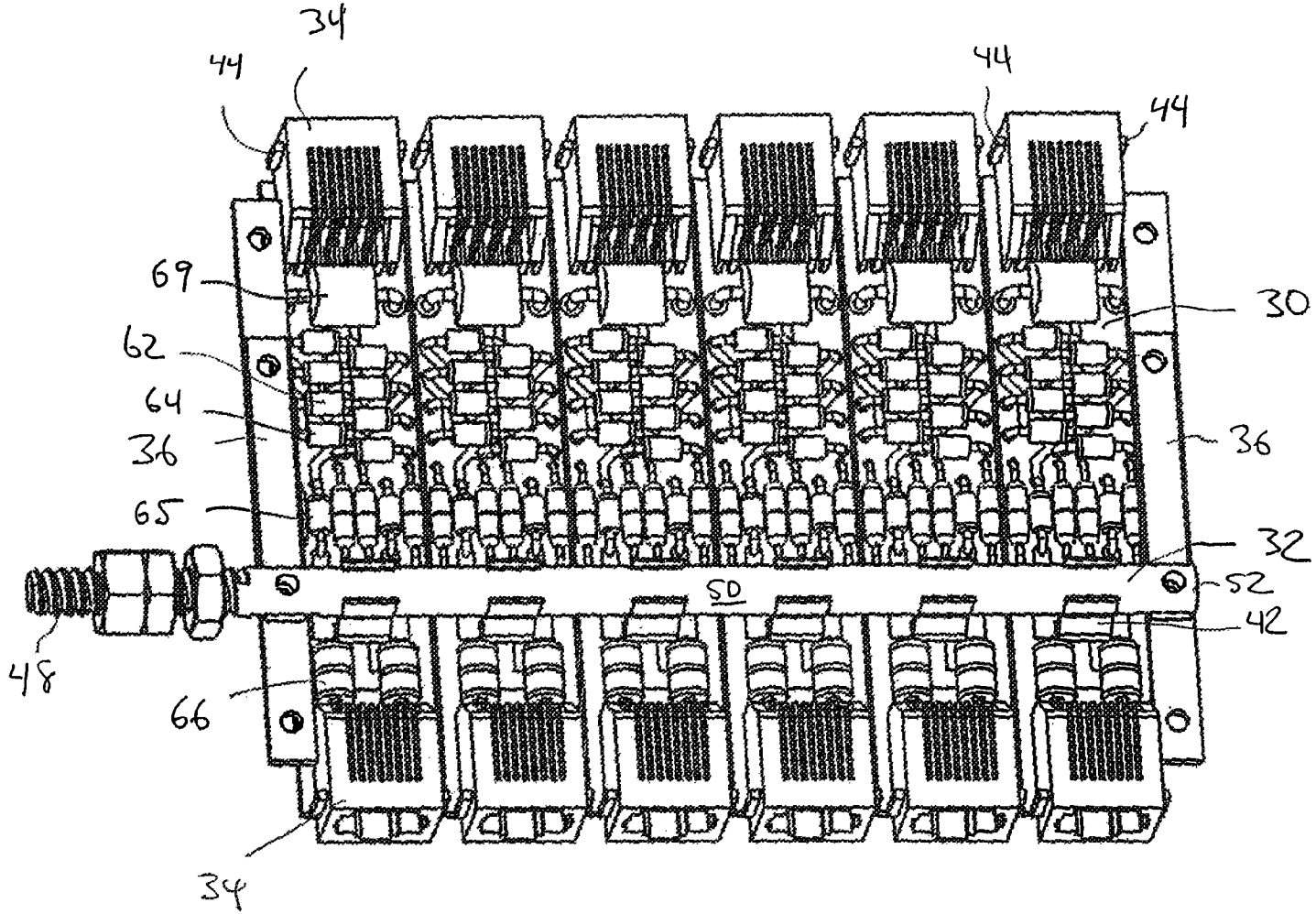
FIG. 4 is an inverted isolated view of surge suppression modules attached to a bus bar contained inside the surge suppression device.

Referring to FIGS. 3 and 4, the surge suppression modules 30 are inserted vertically downward into the slots 40 until a clip 42 on a bottom side of the surge suppression modules 30 (FIG. 4) attaches onto the bus bar 32. Tabs 44 extend laterally out from opposite sides of the connectors 34. When the surge suppression module 30 is inserted into one of the slots 40, the tabs 44 seat against an inside walls 46 of the enclosure 14 while at the same time the clip 42 attaches onto the bus bar 32. This provides three separate anchor points for the surge suppression modules 30 inside the enclosure 14.

The clip 42 electrically connects the surge suppression circuitry 62 on the surge suppression module 30 to ground while also securely holding the surge suppression module 30 inside the enclosure 14. In one embodiment, the connectors 34 are RJ-45 female telecommunication connectors used for T1 telecommunication cables. However, other type of connectors can also be used.

The surge suppression arrangement described above allows individual surge suppression modules 30 to be inserted and removed from the slots 40A-40F without disrupting the electrical connections of the other surge suppression modules 30 coupled to the bus bar 32 or disrupting the operation of the data transmission in the cables 20A and 20B connected to those modules (FIG. 1). For example, if one of the surge suppression modules 30 is damaged or destroyed during a power surge condition, the damaged unit 30 can be removed and another surge suppression module 30 inserted without disrupting the other surge suppression modules 30 that are currently inserted and operating in the enclosure 14.

The bus bar 32 in one embodiment is an elongated rod that includes a first end 48 that extends from one side of the enclosure 14 as shown in FIGS. 1 and 2. A round central body section 50 extends along a bottom side of the enclosure 14 and a second end 52 is suspended above a bottom side of the enclosure 14 by a support plate 36. The support plates 36 are attached in a raised position at opposites ends of the bottom portion 24 of the enclosure 14. The bus bar 32 is then attached at opposite ends in a suspended manner to the support plates 36. The bus bar 32 then operates to suspend and hold the surge suppression modules 30 inside the enclosure 14 while also providing an electrical connection to ground.

Figure 5:
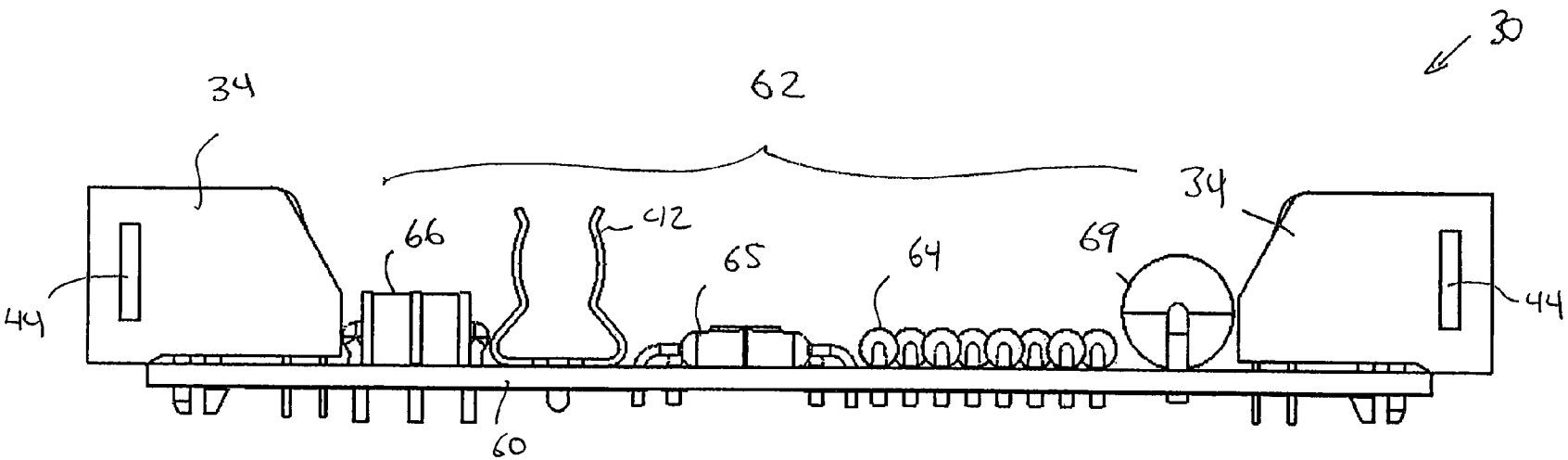
FIG. 5 is a side view of one of the surge suppression modules.

FIG. 5 shows an isolated side view for one of the surge suppression modules 30. Referring to FIGS. 3, 4 and 5, the surge suppression modules 30 include a circuit board 60 containing surge suppression circuitry 62. The connectors 34 are coupled on opposite ends of the circuit board 60. The clip 42 is attached to the circuit board 60 and as described above electrically couples the surge suppression circuitry 62 to the bus bar 32. The clip 42 in one embodiment is the same shape as a fuse clip typically used for connecting to 0.25 inch fuses, similar to the type used in automobiles. The circuit board 60 is an elongated rectangular shape that extends from a front end to a back end inside the enclosure 14 and is approximately 9 centimeters long and 2 centimeters wide.

The surge suppression circuitry 62 is configured to direct power surges detected on the cables 20 (FIG. 1) to the bus bar 32 during a power surge condition. Gas tubes 66 are located adjacent to the clip 42 to provide a short path to ground. Resistors 65 are arranged longitudinally in a row and diodes 64 are arranged in an interleaved manner in two columns. A SAD 69 is located between the diodes 64 and the connector 34.

Figure 6:
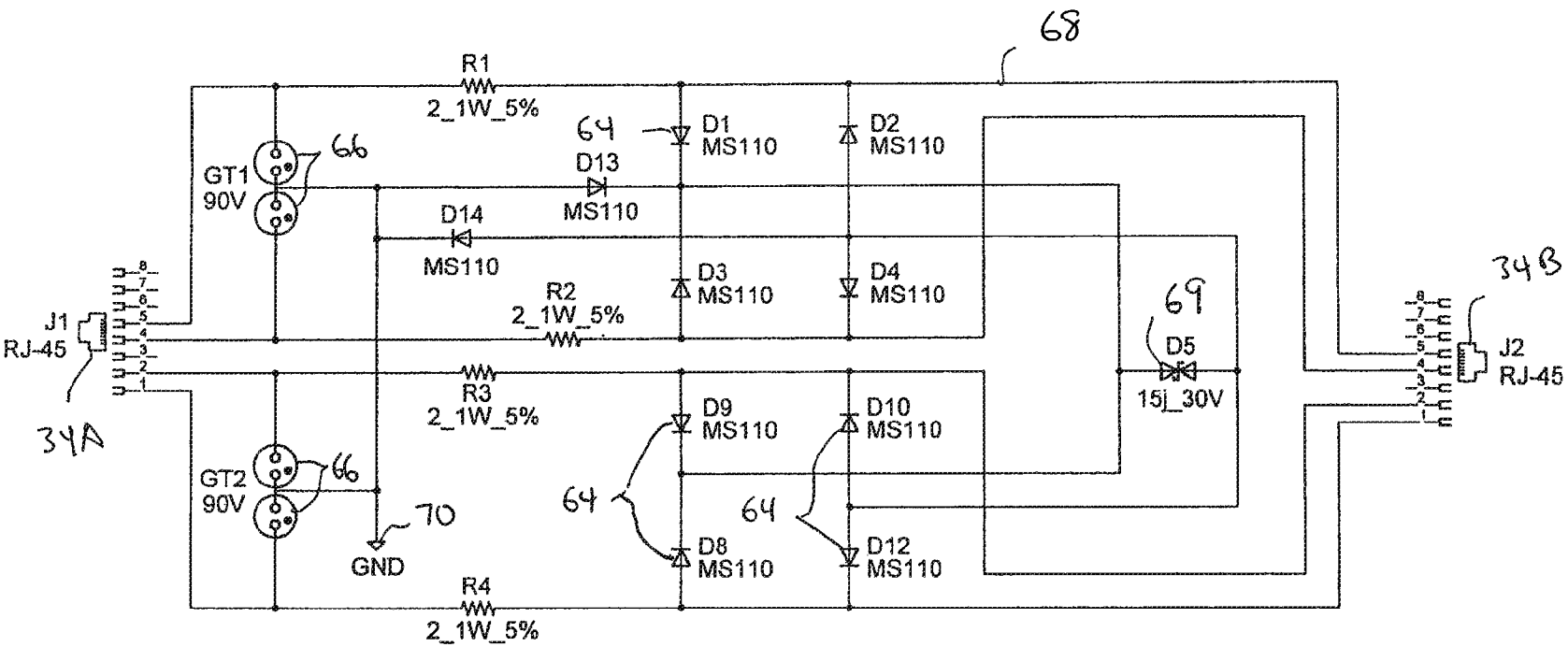
FIG. 6 is a circuit diagram for surge suppression circuitry used in the surge suppression modules.

FIG. 6 is a circuit diagram of the surge suppression circuitry 62. The surge suppression circuitry 62 provides for suppression clamping of electrical transients (increases in voltage above the designed threshold). The surge suppression circuitry 62 utilizes a parallel combination of Silicon Avalanche Diode (SAD) 69 and gas tubes 66. Combining SAD 69 in parallel with gas tubes 66 serves to increase the total system clamping current handling and power/energy dissipation capability. The SAD 69 has a rated voltage of 30 volts +/−5% at 5 milliamperes. The total energy dissipation capability of the surge suppression circuit 62 is around 15 joules of SAD and 10 kiloAmperes of gas tube. The surge suppression circuitry 62 described above can also be replaced with other voltage parts for different applications. For example, SAD 69 could have a rated voltage of 7.5 voltage instead of 30 volts.

For example, a conductor 68 provides a connection between the T1 cables 20A and 20B attached to connectors 34A and 34B. When a power surge generates a voltage above an over voltage threshold value, the gas tube 66 and SAD 69 each couple the conductor 68 to connector 42 which in this case is coupled to ground 70 via the bus bar 32 (FIG. 4). The power surge is directed to ground. When the power surge condition subsides, the conductivity path in connection 68 between connector 34A and 34B is reestablished.

Thus, a single enclosure 14 contains multiple data cable surge suppression modules 30 that are all individually replaceable without disturbing the operation of other operating surge suppression modules. Thus, the operation of other T1 or E1 data cables 20A and 20B connected to the other the surge suppression modules 30 will not be disrupted when one of the surge suppression modules 30 is replaced.

Having described and illustrated the principles of the invention in a preferred embodiment thereof, it should be apparent that the invention may be modified in arrangement and detail without departing from such principles. We claim all modifications and variation coming within the spirit and scope of the following claims.

The invention claimed is:

1. A surge suppression device, comprising:

a bus bar that provides an electrical connection to ground;

multiple surge suppression modules each having independent surge protection circuitry and input and output ends for coupling to telecommunication cabling;

an attachment device associated with each of the surge suppression modules that allows for coupling and decoupling any of the surge suppression modules to the bus bar without disrupting functionality of other surge suppression modules coupled to the bus bar;

an enclosure in which the bus bar is mounted lengthwise with the multiple surge suppression modules attached to the bus bar transversely thereto; and a row of coplanar connectors extending along each of opposite sides of the enclosure, each connector coupled to one of the input and output ends of one of the multiple surge suppression modules.

2. The surge suppression device according to claim 1 in which the enclosure includes at least two enclosure slots on a front end and at least two enclosure slots on a back end of the enclosure that receive and support at least two of said connectors in coplanar rows on each of the front end and the back end of the enclosure.

3. The surge suppression device according to claim 1 wherein the attachment device includes a male element and a female element for receiving the male element.

4. The surge suppression device according to claim 1 wherein the connectors are substantially box shaped and include a female end that receives a male end of plug-in communication cables.

5. The surge suppression device according to claim 1 wherein the connectors are RJ-45 telecommunication connectors.

6. The surge suppression device of claim 1 in which the surge suppression circuitry includes both a silicon avalanche diode (SAD) and a gas tube coupled in parallel across two conductors that extend between the two connectors and a ground conductor coupled to the attachment device.

7. The surge suppression device of claim 1 in which the surge suppression circuitry includes at least two conductors that extend between the two connectors, a resistor in each of the two conductors, a diode bridge coupled between the two conductors, and a silicon avalanche diode (SAD) coupled across the two conductors, the diode bridge coupled to the attachment device for connection to the bus bar.

8. The surge suppression device according to claim 1 in which a single said attachment device is positioned between the connectors of each module.

9. The surge suppression device according to claim 1 in which the enclosure is formed of a plastic material.

10. The surge suppression device according to claim 2 wherein the connectors are configured to engage in the enclosure slots when the surge suppression modules are coupled to the bus bar.

11. The surge suppression device according to claim 2 wherein the connectors include support tabs on opposite sides configured so as to be slidingly received in the enclosure slots.

12. The surge suppression device according to claim 10 in which a single said attachment device is positioned between the connectors of each module.

13. The surge suppression device according to claim 11 wherein at least one of the support tabs faces a support tab of an adjacent surge suppression module connected to the bus bar.

14. A surge suppression device, comprising:

a bus bar that provides an electrical connection to ground;

multiple surge suppression modules each having independent surge protection circuitry and connectors for coupling to telecommunication cabling; and an attachment device associated with each of the surge suppression modules that allows for coupling and decoupling any of the surge suppression modules to the bus bar without disrupting functionality of other surge suppression modules coupled to the bus bar;

the surge suppression circuitry including at least two conductors that extend between the two connectors, a resistor in each of the two conductors, a diode bridge coupled between the two conductors, and a silicon avalanche diode (SAD) coupled across the two conductors, the diode bridge coupled to the attachment device for connection to the bus bar.

15. The surge suppression device according to claim 14 further including an enclosure having at least two enclosure slots on a front end and at least two enclosure slots on a back end of the enclosure that receive and support at least two connectors in coplanar rows on each of the front end and the back end of the enclosure.

16. The surge suppression device according to claim 15 wherein the connectors are configured to engage in the enclosure slots when the surge suppression modules are coupled to the bus bar.

17. The surge suppression device according to claim 14 wherein the attachment device includes a male element, and a female element for receiving the male element.

18. The surge suppression device according to claim 14 wherein the connectors are substantially box shaped and include a female end that receives a male end of plug-in communication cables.

19. The surge suppression device according to claim 14 wherein the connectors are RJ-45 telecommunication connectors.

20. The surge suppression device of claim 14 in which the surge suppression circuitry includes a gas tube coupled in parallel across the two conductors that extend between the two connectors and a ground conductor coupled to the attachment device.

21. The surge suppression device according to claim 14 in which a single said attachment device is positioned between the connectors of each module.

22. The surge suppression device according to claim 14 in which the enclosure is formed of a plastic material.

23. The surge suppression device according to claim 15 wherein the connectors include support tabs on opposite sides configured so as to be slidingly received in the enclosure slots.

24. The surge suppression device according to claim 16 in which a single said attachment device is positioned between the connectors of each module.

25. The surge suppression device according to claim 23 wherein at least one of the support tabs faces a support tab of an adjacent surge suppression module connected to the bus bar.

* * * * *